US009181641B1

(12) United States Patent
Moraca

(10) Patent No.: US 9,181,641 B1
(45) Date of Patent: Nov. 10, 2015

(54) INTERCHANGEABLE KNITTING NEEDLE SYSTEM

(71) Applicant: Mark D. Moraca, Birmingham, AL (US)

(72) Inventor: Mark D. Moraca, Birmingham, AL (US)

( * ) Notice: Subject to any disclaimer, the term of this patent is extended or adjusted under 35 U.S.C. 154(b) by 20 days.

(21) Appl. No.: 14/261,847

(22) Filed: Apr. 25, 2014

(51) Int. Cl.
*D04B 3/02* (2006.01)

(52) U.S. Cl.
CPC ..... *D04B 3/02* (2013.01)

(58) Field of Classification Search
CPC ..... D04B 3/00; D04B 3/02
USPC ..... 66/116, 117, 118
See application file for complete search history.

(56) References Cited

U.S. PATENT DOCUMENTS

| | | | | | |
|---|---|---|---|---|---|
| 1,286,125 | A | | 11/1918 | Sessions | |
| 1,999,691 | A | | 4/1935 | Ghaham | |
| 2,183,791 | A | | 12/1939 | Dunn | |
| 2,208,124 | A | | 7/1940 | Dunn | |
| 2,461,816 | A | | 2/1949 | Giovanini | |
| 2,462,473 | A | | 2/1949 | Delaney | |
| 2,633,720 | A | * | 4/1953 | Robbins | 66/117 |
| 2,695,506 | A | * | 11/1954 | Kohlmann | 66/117 |
| 3,280,595 | A | | 10/1966 | Linstead | |
| 3,384,220 | A | | 5/1968 | Linstead | |
| 4,007,610 | A | | 2/1977 | Linstead | |
| 4,341,094 | A | | 7/1982 | Heide | |
| 4,494,387 | A | | 1/1985 | Phipps | |
| 4,553,410 | A | * | 11/1985 | Okada | 66/117 |
| 4,646,543 | A | * | 3/1987 | Okada | 66/117 |
| 4,680,947 | A | | 7/1987 | Phipps | |
| 4,693,094 | A | | 9/1987 | Kahn | |
| 4,846,351 | A | | 7/1989 | Gardiner | |
| 5,720,187 | A | * | 2/1998 | Matuo | 66/117 |
| 6,397,640 | B1 | | 6/2002 | Williams | |
| 6,983,627 | B1 | | 1/2006 | Eley-Holden-Sotnik | |
| 7,117,693 | B1 | | 10/2006 | Nova | |
| 7,954,342 | B2 | | 6/2011 | Devagnanam | |
| 8,181,489 | B2 | | 5/2012 | Selter | |
| 8,210,003 | B2 | | 7/2012 | Zheng | |
| 8,464,559 | B2 | | 6/2013 | West | |

OTHER PUBLICATIONS elann.com Inc., Addl Click Interchangeable Connector Set, available at http://www.elann.com/Commerce.Web/product.aspx?catID=33&id=125674 (retrieved Oct. 29, 2013).

Great Yarn Company, Denise End Buttons and Extender Set, available at http://www.greatyarncompany.com/Denise-End-Buttons-and-Extender-Set_p_455.html (retrieved Oct. 29, 2013).

(Continued)

*Primary Examiner* — Danny Worrell
(74) *Attorney, Agent, or Firm* — Olive & Olive, P.A.

(57) ABSTRACT

An interchangeable circular knitting needle system with improved reliability and consistency having at least one knitting needle, at least one flexible cable, and a connector assembly to join the needle to the cable. The connector assembly is composed of two members, a plug and a receptacle. The plug may be inserted snugly into the receptacle to ensure a reliable physical connection. An interchangeable circular knitting needle kit is composed of the interchangeable circular knitting needle described above as well as a disconnecting tool for assisting in disconnecting the connector assembly members.

20 Claims, 5 Drawing Sheets

(56) References Cited

OTHER PUBLICATIONS

Denise, Product Demos—Denise Interchangeable Knitting and Crochet, available at http://www.knitdenise.com/pages/product-demos (retrieved Oct. 29, 2013).

Crafts Americana Group, Inc., Options Interchangeable Circular Knitting Needle Cables, available at http://www.knitpicks.com/needles/Options_Interchangeable_Circular_Knitting_Needle_Cables_DKPCables.html (retrieved Oct. 29, 2013).

* cited by examiner

Fig. 7
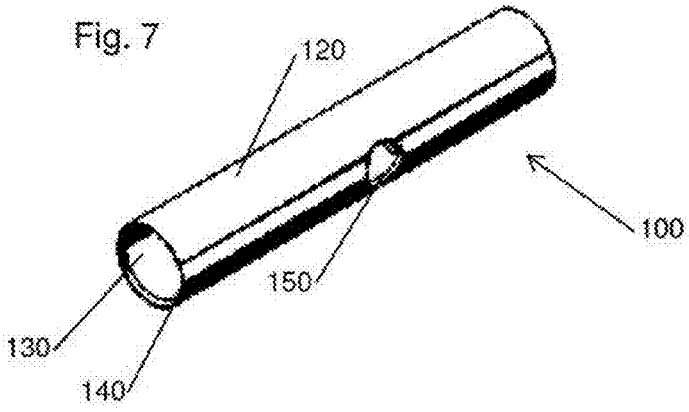
Fig. 8
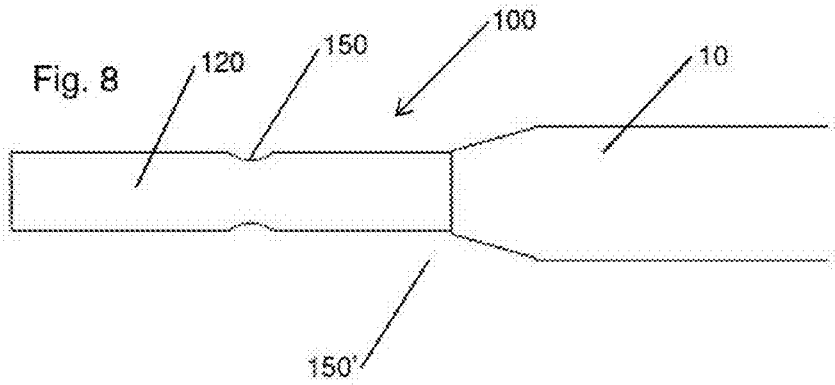
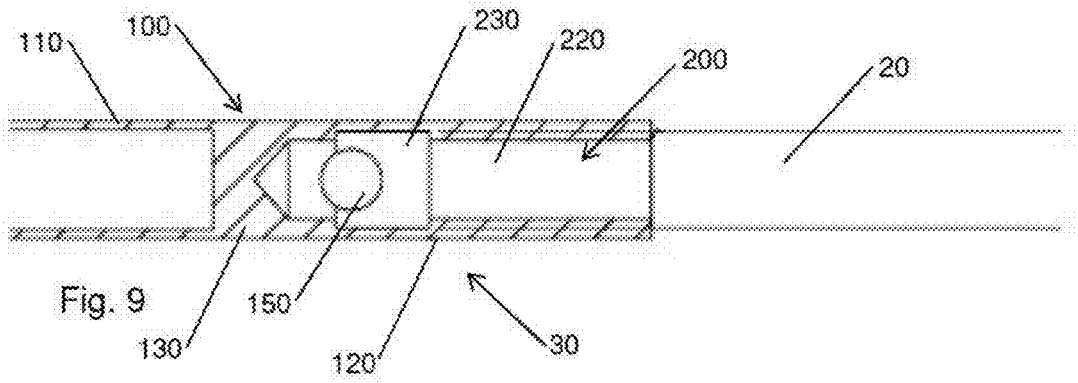
Fig. 9

Fig. 10
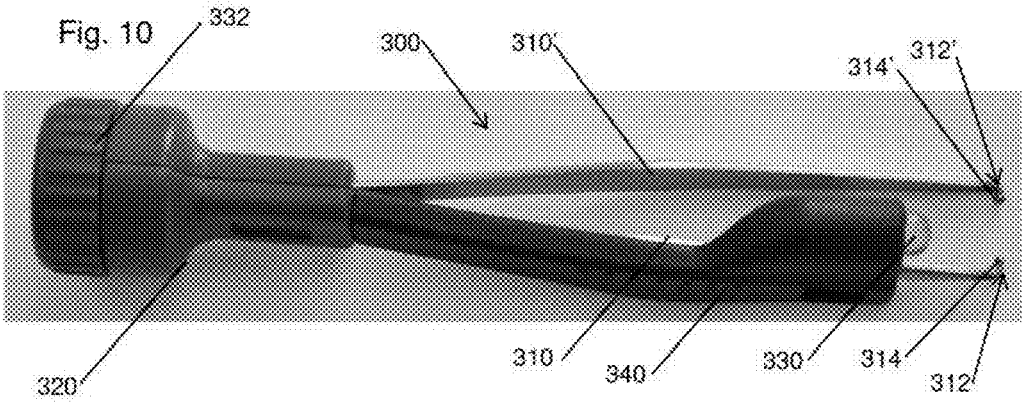
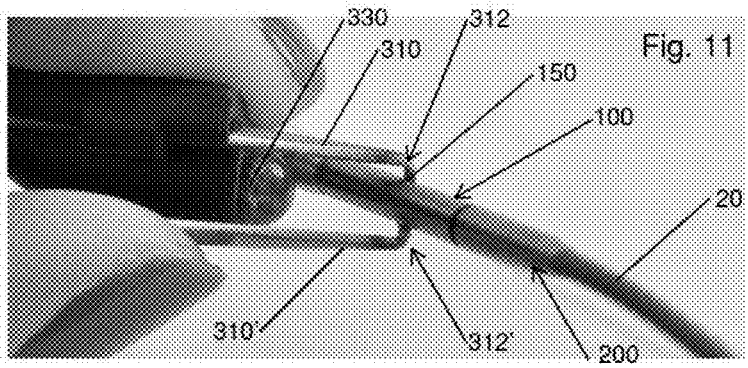
Fig. 11
Fig. 12
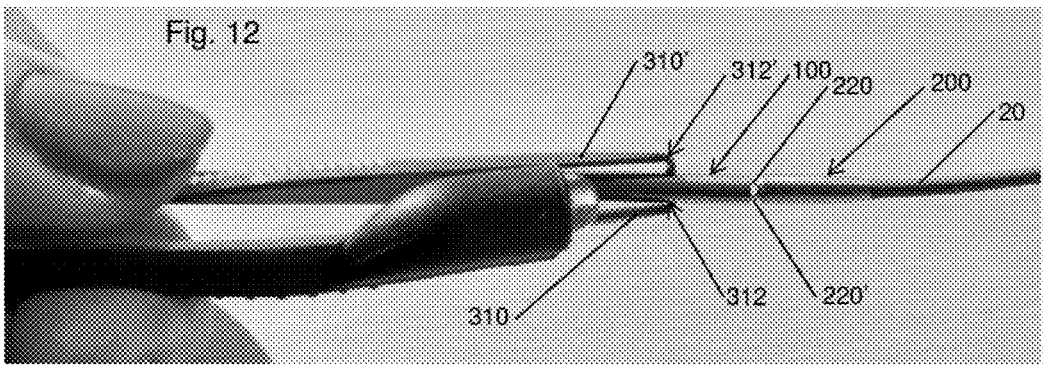

INTERCHANGEABLE KNITTING NEEDLE SYSTEM

FIELD OF THE INVENTION

The invention relates to an interchangeable knitting needle system for circular knitting needles.

BACKGROUND

Knitting needle systems consisting of two knitting needles joined by a flexible cable are generally referred to as circular knitting needles. Circular knitting needles provide users with the ability to knit flat or in the round without incorporating seams. While knitting flat pieces, circular knitting needles provide for more even distribution of fabric and improved ergonomics for users. When used for knitting in the round, circular knitting needles remove the need to continually switch from one needle to the next, eliminate the possibility of stitches falling off the back end of needles, and allow for construction of certain garments to be streamlined. Further information regarding circular knitting needles is provided in U.S. Pat. No. 1,286,125.

Circular knitting needles with interchangeable cables and/or needles are well known in the art. For example, U.S. Pat. Nos. 4,680,947, 4,494,387, and 3,384,220 describe circular knitting needles in which the cables are joined to the needles by threaded connectors.

One disadvantage of many interchangeable circular knitting needle systems is that connectors for components of such systems often may become partially or fully disconnected during the knitting process through the movement of the knitting needles and resulting vibrations. As a result of such a disconnection, stitches may become snagged on the connector or stitches may fall off the needles.

In light of these problems, there exists an opportunity for an improved circular knitting needle system with a connector that will consistently and reliably maintain a connection between a knitting needle and an associated flexible cable. The present invention overcomes the shortcomings of the traditional interchangeable circular knitting needle systems described above.

SUMMARY

In accordance with the invention, there is provided an interchangeable circular knitting needle system with improved reliability and consistency.

There is described herein an interchangeable circular knitting needle system having at least one knitting needle, at least one flexible cable, and a connector assembly to join the needle to the cable. The connector assembly is comprised of two members, a plug and a receptacle. The plug may be inserted snugly into the receptacle to ensure a reliable physical connection. The plug is deformable to allow insertion into such a receptacle and to establish an interference fit engagement.

Also disclosed herein is an interchangeable circular knitting needle kit comprised of the interchangeable circular knitting needle described above and a disconnecting tool for disconnecting the knitting needle and flexible cable when joined through the connector assembly. The tool is provided for assisting in disconnecting the connector assembly members.

BRIEF DESCRIPTION OF THE DRAWINGS

Having briefly described the invention, the same will become better understood from the following description, made with reference to the appended drawings, wherein:

FIG. 7 is a perspective view of an embodiment of a receptacle, which is a component of a connector assembly in an interchangeable circular knitting needle system.

FIG. 8 is a side view of the embodiment of the receptacle depicted in FIG. 7.

FIG. 9 is a sectional view of an embodiment of a connector assembly with an embodiment of a plug and an embodiment of a receptacle connected together.

FIG. 10 is a side view of an embodiment of a disconnecting tool used with the kit of the invention.

FIG. 11 is a perspective view of the embodiment of the disconnecting tool shown in FIG. 10 as it fits into an embodiment of a receptacle.

FIG. 12 is a side view of the embodiment of the disconnecting tool shown in FIG. 10 as it fits into an embodiment of a receptacle and is used to separate the receptacle from an embodiment of a plug.

DETAILED DESCRIPTION

The following description of various embodiments is made with reference to the accompanying drawings.

Figure 1:
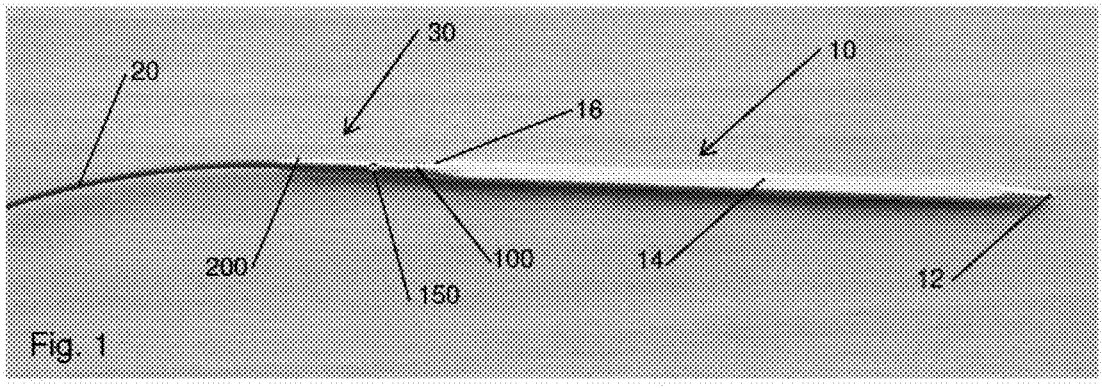
FIG. 1 is a perspective view of an embodiment of an interchangeable circular knitting needle system showing a knitting needle and flexible cable connected together by an embodiment of a connector assembly.
Figure 2:
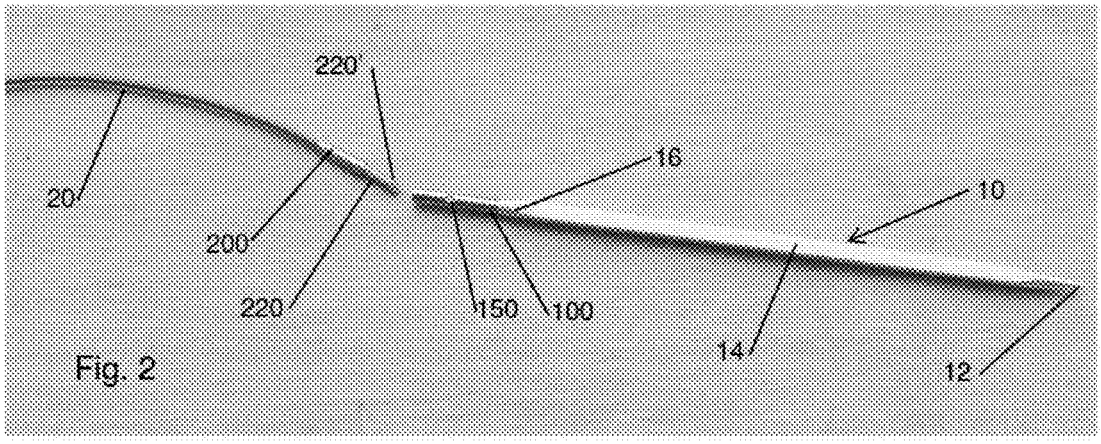
FIG. 2 is a perspective view of an embodiment of an interchangeable circular knitting needle system with an embodiment of a connector assembly shown disconnected.
Figure 3:
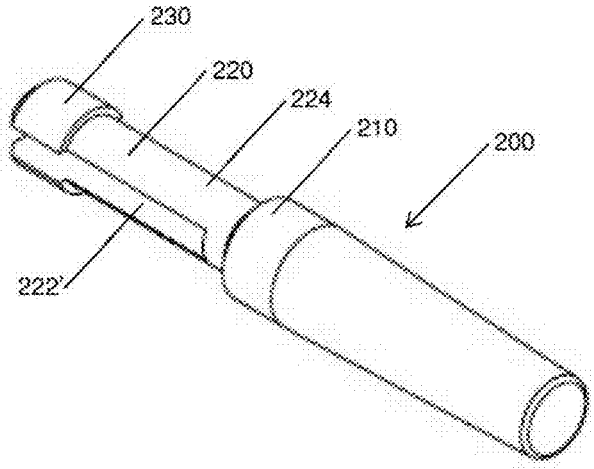
FIG. 3 is a perspective view of an embodiment of a plug, which is a component of a connector assembly in an interchangeable circular knitting needle system.
Figure 4:
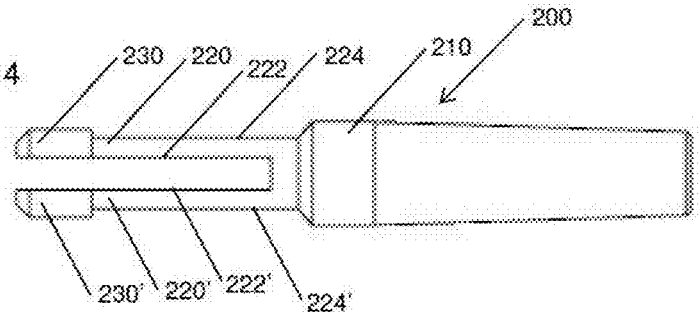
FIG. 4 is a side view of the embodiment of a plug depicted in FIG. 3.
Figure 5:
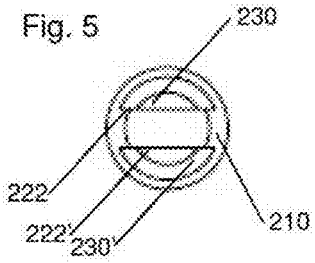
FIG. 5 is an end view of the embodiment of a plug depicted in FIG. 3.
Figure 6:
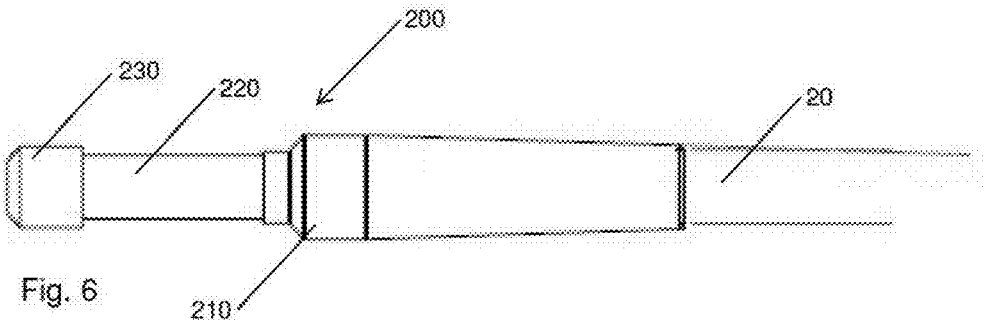
FIG. 6 is a second side view rotated 90 degrees from the view of FIG. 4, of the embodiment of a plug depicted in FIG. 3.

In accordance with an embodiment of the invention as is shown in FIGS. 1-2, the interchangeable circular knitting needle system is comprised of at least one knitting needle 10, at least one flexible cable 20 capable of receiving looped knitted material, and a connector assembly 30 to join the needle 10 to the cable 20. The knitting needle 10 is comprised of a tip 12 and a shaft 14, which extends from the tip 12 and terminates at a base 16 opposite the tip 12. The base 16 is connected to a connector assembly 30. The system may further include a second knitting needle, joined to the flexible cable 20 through connection with a second connector assembly (not shown) at an opposite end thereof. The system also may include a plurality of flexible cables, each joined together with additional connector assemblies (not shown), to extend the amount of looped knitted material capable of being held by the interchangeable circular knitting needle system.

The connector assembly 30, an embodiment of which may also be seen in FIG. 9, includes two elements, a plug 200 and a receptacle 100. The plug 200 may be inserted snugly into the receptacle 100 to ensure a reliable physical connection between the plug 200 and the receptacle 100. The plug 200 and receptacle 100 should be similarly sized in circumference and coextension such that, when joined, looped knitted material may be smoothly passed over the exterior of the knitting needle 10 and the connector assembly 30 onto the flexible cable 20 without catching or snagging.

In accordance with the depicted embodiment as shown more particularly in FIGS. 7-9, the receptacle 100 is hollow and generally cylindrical in shape, both along its exterior surface 120 and interior surface 130 delineating the hollow interior. The receptacle 100 is attached at one end to either the base 16 of a knitting needle 10 (shown in FIGS. 1-2) or flexible cable 20 (not shown). The opposite end of the receptacle 10 has a receiving aperture 140 for receiving the plug 200. The receptacle 10 further may include two removal apertures 150, 150', each of which may be generally circular in shape, on opposite sides of the receptacle 100. Incorporation of the removal apertures 150, 150' in the receptacle 100 may be useful in disconnecting the receptacle 100 and plug 200 as further described below.

In accordance with a depicted embodiment as shown more particularly in FIGS. 3-6, the plug 200 is made up of two spaced prongs 220, 220', which fit into the receptacle 100. Each prong 220, 220' may be substantially flat along the interior side 222, 222', which is spaced from and faces the other prong 220, 220'. The exterior side 224, 224' of each prong 220, 220' may have a rounded protrusion 230, 230', at the end opposite the plug base 210, for insertion into the receptacle 100. As shown in the depicted embodiment, the spacing between the prongs 220, 220' is such that the protrusions 230, 230' engage the interior surface 130 of the receptacle 100 and compress against each other resulting in a compression engagement within the receptacle 100. The plug base 210 may be connected to either the proximal end of a knitting needle 10 (not shown) or flexible cable 20 (shown in FIGS. 1-2, 11-12).

Variations in design of the plug 200 will be obvious to one skilled in the art. For example, there may be gradual, abrupt, or no appreciable tapering of the protrusions 230, 230' at their distal ends. Also, the distal ends of the prongs may be pointed, rounded, or squared.

As a result of compressive engagement with the interior surface 130 of the receptacle 100, as is shown in FIG. 9, the protrusions 230, 230' of the prongs 220, 220' of the plug 200, when fully engaged therein, maintain a connection within the receptacle 100 such that the plug 200 will not accidentally disengage from the receptacle 100. Due to the nature of the movements used while knitting, It is preferable that the flexible cable 20 be able to freely rotate independently of the direction the knitting needle 10 is manipulated. Depending on the materials and methods used in manufacturing the plug 200 and receptacle 100, the prongs 220, 220' may freely rotate within the hollow interior of the receptacle 100 while still being sufficiently engaged with the interior surface 130 such that the prongs 220, 220' do not unintentionally disconnect from the receptacle 100. The protrusions 230, 230' may assist in ensuring such a connection. In the alternative, the connector assembly 30 may be manufactured such that the prongs 220, 220' do not freely rotate within the hollow interior of the receptacle 100 but are instead engaged by the removal apertures 150, 150'. In such embodiments, it is preferable that the connection between the cable 20 and the connector assembly 30 allow for rotation of the cable 20 independently of the connector assembly 30. Such rotation may be obtained, for example, by using a ball and socket joint to connect the cable 20 and the connector assembly 30.

An interchangeable circular knitting needle kit is composed of the interchangeable circular knitting needle system described above, including at least one knitting needle 10, at least one flexible cable 20, and a connector assembly 30 to join the needle 10 to the cable 20. The kit may also include a disconnecting tool 300, an embodiment of which is depicted in FIGS. 10-12. The disconnecting tool 300 is provided for assisting in disconnecting the plug 200 and receptacle 100 of the connector assembly 30.

The disconnecting tool 300 is comprised of modified tweezers having two arms 310, 310' joined together at a base 320. At the distal ends of the arms 310, 310' are tips 312, 312', which are preferably turned at approximately a 90 degree angle, each toward the other. The tips 312, 312' may include protrusions, such as the bulbs 314, 314' shown in the depicted embodiment, at each distal end. These bulbs 314, 314' provide for the tips 312, 312' to enter into and engage with use the removal apertures 150, 150' of the receptacle 100 without inadvertently disengaging from the connector assembly 30.

The disconnecting tool 300 may further comprise a light 330, attached to one arm 310, a power supply for providing power to the light 330 (e.g., a battery) (not shown), and a switch 332 attached to the disconnecting tool 300 for controlling the power supply of the light 300. The disconnecting tool 300 may also further comprise a comfort grip 340 for providing additional traction in gripping and using the disconnecting tool 300. The light 330 faciltates viewing during disconnection operation.

In order to fit the plug 200 within the receptacle 100, a user of the interchangeable circular knitting needle system may simply insert the protrusions 230, 230' at the distal ends of the prongs 220, 220' of the plug 200 into the receiving aperture 140 of the receptacle 100 and push the prongs 220, 220' of the plug 200 into the interior of the receptacle 100. For easier insertion, the user may squeeze together the prongs 220, 220' of the plug 200 before inserting the protrusions 230, 230' into the receiving aperture 140 of the receptacle 100.

To remove the plug 200 from the receptacle 100, as is depicted in FIGS. 11-12, the user may align the protrusions 230, 230' of the prongs 220, 220' with the removal apertures 150, 150' within the interior surface 130 of the receptacle 100. The user may then use the disconnecting tool 300 to squeeze the prongs 220, 220' together by inserting the tips 312, 312' of the disconnecting tool 300 into the removal apertures 150, 150' of the receptacle 100 and squeezing the two arms 310, 310' together. This squeezing motion will cause the tips 312, 312' of the disconnecting tool 300 to engage with the protrusions 230, 230' of the prongs 220, 220' and compress the prongs 220, 220' toward each other. With a small pull on either the receptacle 100 or the plug 200, the tips 312, 312' of the disconnecting tool 300 are engaged with the side of the removal apertures 150, 150' and may be used to pull the receptacle 100 away from the plug 200 or, alternately, to hold receptacle 100 and allow pulling of plug 200 out of the receptacle 100.

Depending on the materials and methods of manufacture used to make the connector assembly 30, rather than using the disconnecting tool 300, the user may be able to remove the plug 200 from the receptacle 100 apart by gripping and pulling in opposite directions the cable 20 and knitting needle 10 or the plug 200 and the receptacle 100. This may require strength that some users do not have, and it also may make the connection between the plug 200 and receptacle 100 less reliable due to the eventual deformation of the prongs 220, 220'. In the event that this method is preferred, the removal apertures 150, 150' are not required for the construction of the receptacle 100.

Figure 13:
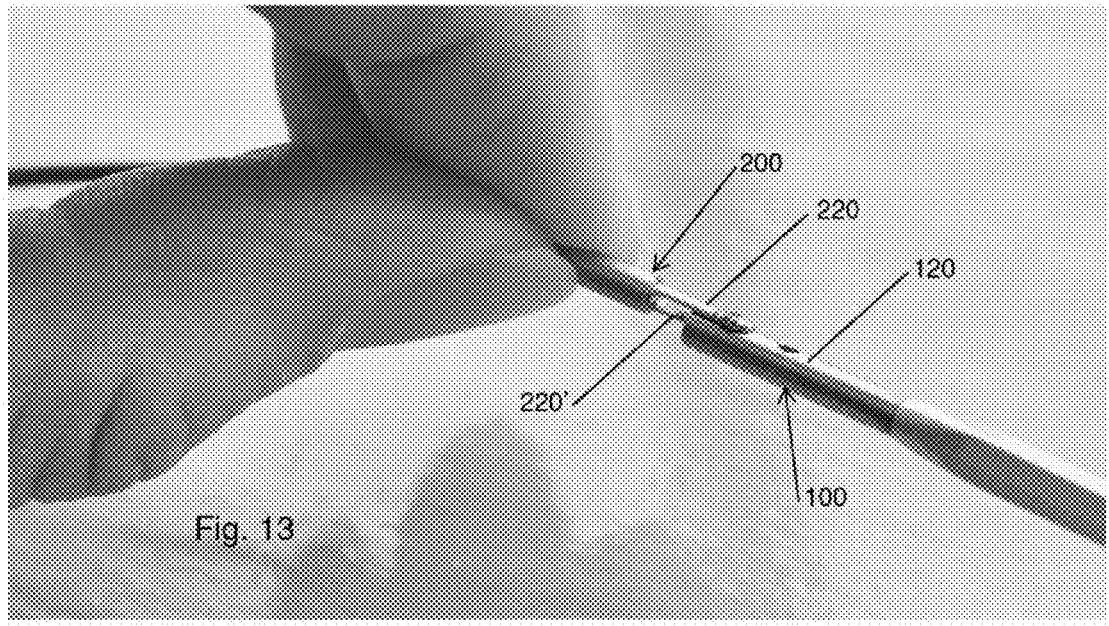
FIG. 13 is a perspective view of an embodiment of a receptacle being used to separate the prongs of an embodiment of a plug.

Should the prongs 220, 220' become deformed such that there is concern regarding the reliability of the connection between the plug 200 and the receptacle 100, a tool may be used to correct the deformity. A variety of things may be used as this tool, including, as depicted in FIG. 13, the receptacle 100. In order to spread apart the prongs 220, 220', a single prong 220' may be inserted into the receptacle 100, while the other prong 220 slides along the exterior surface 120 of the receptacle 100. Other tools that could be used include, but are not limited to, a plate, a wedge, tweezers, or pliers.

The dimensions of the individual components of the interchangeable circular knitting needle system described herein should be selected and adapted to one another in such a way that the plug 200 fits into the receptacle 100 such that there can be no unintentional disengagement of the a knitting needle 10 and flexible cable 20. Depending on the desired rotation capability, the connector assembly 30 may also be manufactured such that the dimensions allow the plug 200 to freely rotate within the receptacle 100.

The foregoing details are exemplary only. Other modifications that might be contemplated by those of skill in the art are within the scope of this invention, and are not limited by the examples illustrated herein. In addition, it is noted that an Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

What is claimed is:

1. An interchangeable knitting needle system, comprising:

a. at least one knitting needle having a tip, a shaft extending from the tip and terminating at a base opposite the tip, the base connected to a coupling assembly for connecting at least one knitting needle and at least one flexible cable;

b. at least one flexible cable capable of receiving looped knitted material thereon upon engagement with the at least one knitting needle by connecting to the coupling assembly at one end of the at least one flexible cable; and c. the coupling assembly, comprising a plug and a receptacle, i. the receptacle having a hollow interior and being generally cylindrical in shape both along an exterior surface and an interior surface and defining a hollow interior, and said receptacle comprising a receiving aperture for receiving the plug, and ii. the plug comprising two spaced prong extensions sized to fit into the receptacle and, while compressed within the receptacle, to engage the interior surface of the receptacle and compress against each other resulting in compression engagement within the receptacle.

2. The interchangeable knitting needle system of claim 1, wherein the two spaced prong extensions are sized to fit into the receptacle and, while compressed within the receptacle, to engage the interior surface of the receptacle and compress against each other resulting in a freely rotatable compression engagement within the receptacle.

3. The interchangeable knitting needle system of claim 1, wherein the receptacle further comprises two removal apertures on opposite sides of the receptacle providing two openings through the receptacle to the hollow interior.

4. The interchangeable knitting needle system of claim 1, wherein the base of the at least one knitting needle is connected to the receptacle of the coupling assembly and wherein one end of the at least one flexible cable is connected to the plug of the coupling assembly.

5. The interchangeable knitting needle system of claim 1, wherein the base of the at least one knitting needle is connected to the plug of the coupling assembly and wherein one end of the at least one flexible cable is connected to the receptacle of the coupling assembly.

6. The interchangeable knitting needle system of claim 1, wherein each of the two spaced prong extensions are substantially flat along an interior side facing the other prong extension.

7. The interchangeable knitting needle system of claim 1, wherein each of the two spaced prong extensions comprises a rounded protrusion at a distal end.

8. The interchangeable knitting needle system of claim 1, further comprising a. a second knitting needle having a tip, a shaft extending from the tip and terminating at a base opposite the tip, the base connected to a second coupling assembly for connecting second knitting needle and the at least one flexible cable;

b. the at least one flexible cable further connected to the second coupling assembly at one end of the flexible cable; and c. the second coupling assembly, comprising a plug and a receptacle, i. the receptacle having a hollow interior and being generally cylindrical in shape both along an exterior surface and an interior surface and defining a hollow interior, and said receptacle comprising a receiving aperture for receiving the plug, and ii. the plug comprising two spaced prong extensions sized to fit into the receptacle and, while compressed within the receptacle, to engage the interior surface of the receptacle and compress against each other resulting in compression engagement within the receptacle.

9. The interchangeable knitting needle system of claim 1, wherein the at least one flexible cable comprises a plurality of flexible cables capable of receiving looped knitted material thereon upon engagement with the at least one knitting needle by connecting to an end of a first flexible cable through a second coupling assembly at one end of the first flexible cable and being joined to one another by connecting to a plurality of coupling assemblies; and the plurality of coupling assemblies, each comprising a plug and a receptacle, a. the receptacle having a hollow interior and being generally cylindrical in shape both along an exterior surface and an interior surface and defining a hollow interior, and said receptacle comprising a receiving aperture for receiving the plug and further comprising two removal apertures on opposite sides of the receptacle providing two openings through the receptacle to the hollow interior, and b. the plug comprising two spaced prong the plug comprising two spaced prong extensions sized to fit into the receptacle and, while compressed within the receptacle, to engage the interior surface of the receptacle and compress against each other resulting in a freely rotatable compression engagement within the receptacle.

10. An interchangeable knitting needle kit, comprising:

a. at least one knitting needle having a tip, a shaft extending from the tip and terminating at a base opposite the tip, the base connected to a coupling assembly for connecting at least one knitting needle and at least one flexible cable;

b. at least one flexible cable capable of receiving looped knitted material thereon upon engagement with the at least one knitting needle by connecting to the coupling assembly at one end of the flexible cable;

c. the coupling assembly, comprising a plug and a receptacle, i. the receptacle having a hollow interior and being generally cylindrical in shape both along an exterior surface and an interior surface and defining a hollow interior, and said receptacle comprising a receiving aperture for receiving the plug and further comprising two removal apertures on opposite sides of the receptacle providing two openings through the receptacle to the hollow interior, and ii. the plug comprising two spaced prong extensions sized to fit into the receptacle and, while compressed within the receptacle, to engage the interior surface of the receptacle and compress against each other resulting in compression engagement within the receptacle; and d. a disconnecting tool for disconnecting the plug and the receptacle of at least the coupling assembly, the disconnecting tool comprising two arms connected at a base and each terminating at a tip opposite the base, the tips each turned at approximately a 90 degree angle and sized to fit within the two removal apertures of the receptacle.

11. The interchangeable knitting needle kit of claim 10, wherein the two spaced prong extensions are sized to fit into the receptacle and, while compressed within the receptacle, to engage the interior surface of the receptacle and compress against each other resulting in a freely rotatable compression engagement within the receptacle.

12. The interchangeable knitting needle kit of claim 10, wherein the base of the at least one knitting needle is connected to the receptacle of the coupling assembly and wherein one end of the at least one flexible cable is connected to the plug of the coupling assembly.

13. The interchangeable knitting needle kit of claim 10, wherein the base of the at least one knitting needle is connected to the plug of the coupling assembly and wherein one end of the at least one flexible cable is connected to the receptacle of the coupling assembly.

14. The interchangeable knitting needle kit of claim 10, wherein each of the two spaced prong extensions are substantially flat along an interior side facing the other prong extension.

15. The interchangeable knitting needle kit of claim 10, wherein each of the two spaced prong extensions comprises a rounded protrusion at a distal end.

16. The interchangeable knitting needle kit of claim 10, further comprising a. a second knitting needle having a tip, a shaft extending from the tip and terminating at a base opposite the tip, the base connecting to a second coupling assembly for joining the second knitting needle and the at least one flexible cable;

b. the at least one flexible cable further connected to the second coupling assembly at one end of the flexible cable; and c. the second coupling assembly, comprising a plug and a receptacle, i. the receptacle having a hollow interior and being generally cylindrical in shape both along an exterior surface and an interior surface and defining a hollow interior, and said receptacle comprising a receiving aperture for receiving the plug and further comprising two removal apertures on opposite sides of the receptacle providing two openings through the receptacle to the hollow interior, and ii. the plug comprising two spaced prong extensions sized to fit into the receptacle and, while compressed within the receptacle, to engage the interior surface of the receptacle and compress against each other resulting in a freely rotatable compression engagement within the receptacle.

17. The interchangeable knitting needle kit of claim 10, wherein the at least one flexible cable comprises a plurality of flexible cables capable of receiving looped knitted material thereon upon engagement with the at least one knitting needle by connecting to an end opposite the needle—of a first flexible cable through a second coupling assembly at one end of the first flexible cable and being joined to one another by connecting to a plurality of coupling assemblies; and the plurality of coupling assemblies, each comprising a plug and a receptacle, a. the receptacle having a hollow interior and being generally cylindrical in shape both along an exterior surface and an interior surface and defining a hollow interior, and said receptacle comprising a receiving aperture for receiving the plug and further comprising two removal apertures on opposite sides of the receptacle providing two openings through the receptacle to the hollow interior, and b. the plug comprising two spaced prong the plug comprising two spaced prong extensions sized to fit into the receptacle and, while compressed within the receptacle, to engage the interior surface of the receptacle and compress against each other resulting in a freely rotatable compression engagement within the receptacle.

18. The interchangeable knitting needle kit of claim 10, wherein the tips of disconnecting tool each further comprises a bulb sized to fit within the two removal apertures of the receptacle and shaped to avoid inadvertent disengagement with the two removal apertures of the receptacle.

19. The interchangeable knitting needle kit of claim 10, wherein the disconnecting tool further comprises a light attached to one arm, a power supply for supplying power for the light, and a switch attached to the disconnecting tool for controlling the power supply of the light.

20. The interchangeable knitting needle kit of claim 10, wherein the disconnecting tool further comprises at least one comfort grip attached to at least one arm.

* * * * *